United States Patent [19]

Miceli

[11] Patent Number: 4,669,140

[45] **Date of Patent: * Jun. 2, 1987**

[54] POCKET FOLDING TOOL AND KNIFE SYSTEM

[76] Inventor: Philip V. Miceli, 1900 Shanklin Ave., Baltimore, Md. 21234

[ * ] Notice: The portion of the term of this patent subsequent to Mar. 10, 2004 has been disclaimed.

[21] Appl. No.: 624,022

[22] Filed: Jun. 25, 1984

[51] Int. Cl.[4] ..... B26B 11/00; B25B 7/22

[52] U.S. Cl. ..... 7/158; 7/118; 7/128; 7/129; 7/132; 7/165; 30/153

[58] Field of Search ..... 7/100, 106, 114, 118, 7/128, 146, 158, 165, 119, 167, 129, 132, 159–163; 81/424, 318, 324, 329, 331–333; 30/125, 142, 153, 255, 262

[56] References Cited

U.S. PATENT DOCUMENTS

| | | | |
|---|---|---|---|
| 276,793 | 5/1883 | Erdman et al. | 7/128 |
| 572,808 | 12/1896 | Killian | 7/128 X |
| 728,728 | 5/1903 | Kirlin | 7/158 X |
| 1,334,965 | 3/1920 | Ridings | 81/424 X |
| 2,611,181 | 9/1952 | Coulter | 7/106 X |
| 2,714,249 | 8/1955 | Clark et al. | 30/153 |
| 3,742,533 | 7/1973 | Brunette | 7/165 |
| 4,097,945 | 7/1978 | Scott | 7/158 X |
| 4,238,862 | 12/1980 | Leatherman | 7/128 |
| 4,287,623 | 9/1981 | Tarran | 7/158 |
| 4,330,937 | 5/1982 | Cope | 30/225 X |
| 4,364,174 | 12/1982 | De Asis | 30/153 |
| 4,442,559 | 4/1984 | Collins | 7/158 |

*Primary Examiner*—Frederick R. Schmidt
*Assistant Examiner*—Debra S. Meislin
*Attorney, Agent, or Firm*—John F. McClellan, Sr.

[57] ABSTRACT

A folding pocket tool and knife of the type having paired handles pivotal to a blade for enclosing or extending the blade depending on pivoted position has an improved implement holding tool block that passes through an implement and co-acting with this, blade centerers on each handle hold the implement centrally between them. An economical liner-free aluminum handle embodiment has reinforcement and scarring-preventing spacers adapted for press-fit assembly. Clip-on attachment and other structure provide plier sections. A container provides advantageous "T"-handle facility for boring with the system, protrusive head pivotal fasteners facilitate scraping operation, and novel storage provisions are described.

18 Claims, 18 Drawing Figures

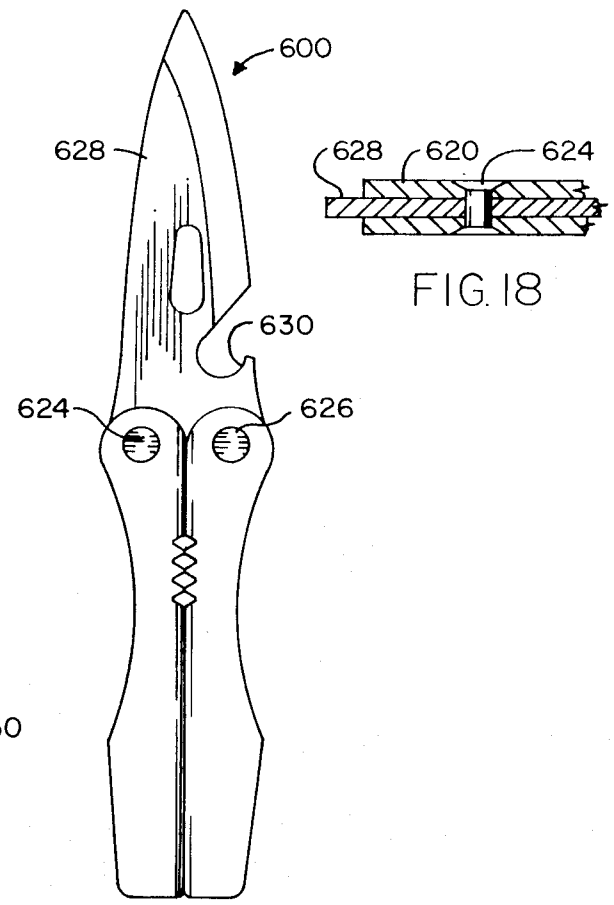
FIG. 17
FIG. 18
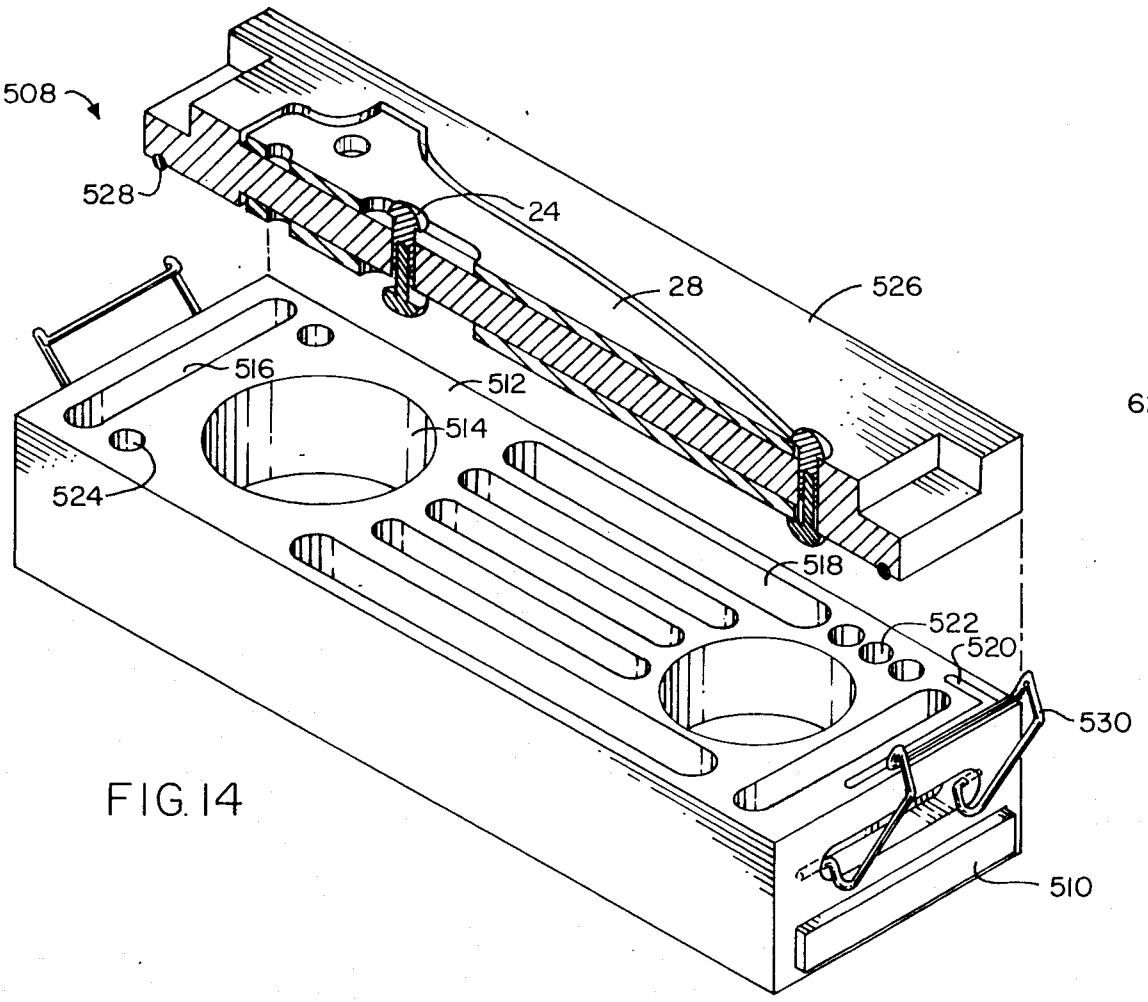
FIG. 14

POCKET FOLDING TOOL AND KNIFE SYSTEM

Cross-reference is made to my copending application Ser. No. 479,841 filed Mar. 28, 1983 for FOLDING POCKET TOOL AND KNIFE of which this is a continuation-in-part for which Notice of Allowance has been received and for which issue fee has been paid.

FIELD OF THE INVENTION

This invention relates generally to hand tools and specifically to a combination folding pocket tool and knife system.

SUMMARY OF THE INVENTION

My copending application discloses a tool system of the type named, with paired handles pivotal for enclosing and for exposing a double-edge, pointed blade with special features including three screwdriver blade portions at the butt of the blade. Provisions for holding saws and punches at one end of the tool, and for using the tool as a wire cutter and as a plier were also disclosed.

A principal object of the present invention is to extend and refine a system of the type disclosed, in embodiments making it more versatile and less expensive.

Further objects are to provide new accessory features, both integral and removable, and to provide interchangeable replacement blade features that co-act to make use of the invention more versatile.

The above and other objects and advantages of this invention will become more readily apparent on examination of the following description, including the drawings in which like reference numerals refer to like parts.

FIG. 14 is an exploded perspective view of a carry-case for the system of this invention with spares;

Figure 16:
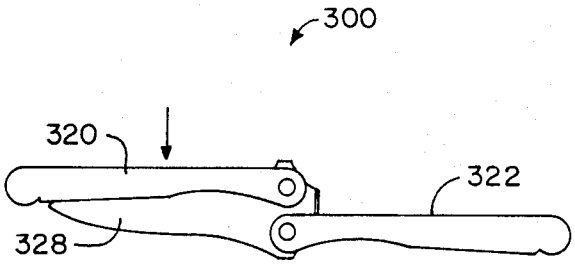

FIG. 16 similarly shows use as a dice-cut knife;

FIG. 17 is an elevational view of a further embodiment; and

FIG. 18 is a sectional view of a portion thereof.

DETAILED DESCRIPTION

Figure 1:
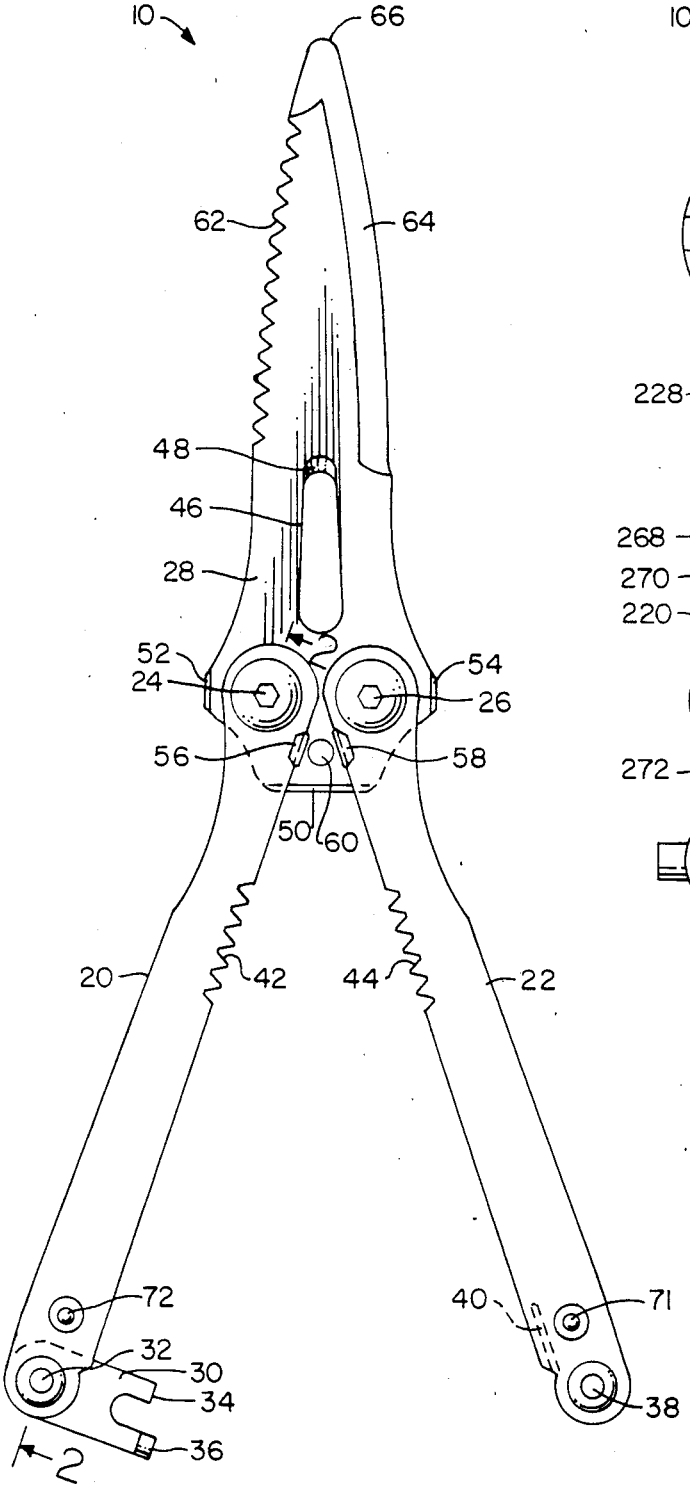
FIG. 1 is a face view of an embodiment of the tool, partially deployed for use.
Figure 2:
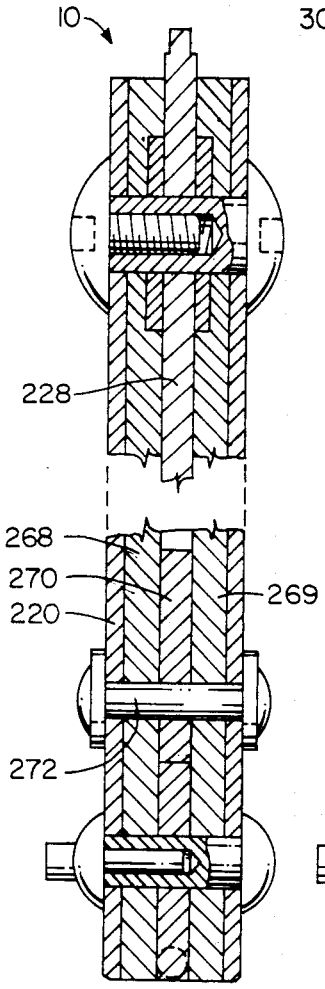
FIG. 2 is a sectional view of an alternative embodiment adopted from 2—2, FIG. 1 but showing the assembly in folded mode.
Figure 3:
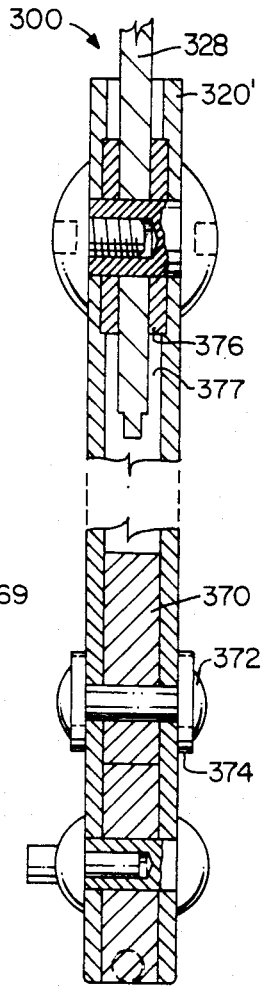
FIG. 3 is an alternative-embodiment sectional view similar to the view in FIG. 2, but with the blade deployed and with thickness of some portions exaggerated, for exposition.

FIG. 1 shows the invention in embodiment 10 as having generally, in similar arrangement to those of my said application Ser. No. 479,481: "U"-section paired handles 20, 22 pivotally positionable by respective fasteners 24, 26 at a first end to knife blade 28, so that according to pivotal position the knife blade is exposed or is substantially enclosed in the "U"-sections. The fasteners permit easy and quick blade removal and replacement. At a second end the handles have means for attaching an implement such as a saw blade, in the form of a tool block 30 pivoted to the first handle by a two-part press-fit rivet or pin 32, which may have an integral protrusion to serve as a spanner wrench jaw. To receive the bifurcated end portions 34, 36 of the tool block 30, a second pin, 38, which may form also a spanner wrench jaw is similarly mounted to the second handle through a suitable hole therein. (One type of threaded fastener is the well known "drilled spanner", typified by a bolt, having a flat round head with two holes drilled parallel in it equidistant from the axis. A known type spanner wrench for engaging the holes and turning the fastener has a pair of jaws or protrusive pins parallel to each other and either fixed the required distance apart, or adjustably fixable as by a caliper arrangement, or, as indicated, the distance between the parallel pins is adjustable by having a pin on an end of each of two arms adjustably pivoted together as at pivotal fasteners 24, 26, in FIG. 1. The provision is also shown in FIGS. 2 and 3). The tool block 30 is preferably of steel 0.085 inch (2 mm) thick to fit the space in the "U"-section handles. This permits the tool block to pass through implements held rather than to receive them in tool block openings. A saw-holding slot 40 is provided longitudinally in the second handle. The embodiment 10 may have also a plier section in the form of integral, opposed serrated jaws 42, 44 in the convex-curve part of the "U"-section of each handle intermediate the length of the handle. The handles are preferably of case-hardening plated steel or stainless steel, hardened at jaws 42, 44 in this embodiment. The blade may have a longitudinal, tapered-side slot 46 with the smaller rounded end 48 in the form of a knife edge incline, for pulling tacks, sharpening pencils, and the like. At the butt end the blade has a substantially square-section screwdriver-like portion, 50, and oriented at a right angle laterally outward adjacent this a pair of screwdriver blades 52, 54. A wire-cutter section comprises two coined edge cutter blades 56, 58 opposed in the handles at the overlap with the butt end of the knife blade, and with a dual purpose hole 60 in the knife blade permitting passage of a wire through it. The opposite face of each handle has at locations opposed to 56, 58, clearances to avoid overlapping the hole in the knife blade. The knife blade may have a serrated edge 62, a plain edge 64, and a slightly rounded tip 66. Press-rivets 71, 72 hold blade centering elements explained later.

As noted, improvements in embodiment 10 include a substantially thinner tool block 30 than the tool block in FIG. 3, better adapting it for holding an implement such as a saw blade, and, further, for holding the implement centered, all with or without a full liner in the handles.

The internal construction of the knife shown in FIG. 1 may be either like that of FIG. 2 or that of FIG. 3; both feature substantially thin blocks and wear resistant structure and easy blade-replacement.

FIG. 2 diagrams portions of structure of a full liner 268, 269, in a handle 220. Knife stop spacer or blade centered 270 is a block of metal held at 272 for positioning the knife blade in the folded position, as will be described. The liner and the centered may be of brass so as not to corrode and not to damage the blade 228.

FIG. 3 is a view similar to that of FIG. 2 but shows a preferred embodiment 300 with liner-free construction for great economy (less than half cost) in an aluminum handle embodiment. Each blade centered 370 (371) fits tightly between the arms of the "U"-section, and is held by a press-fit fastener, 372. The fastener preferably has a spacer 374 under the head at each end to prevent scarring of the aluminum on assembly. Similarly, to prevent marring of the aluminum under heavy use, the arms 320' of each "U"-section are isolated from the blade 328 by reinforcing member 376 that is inset for compact fit in the handle. Members 376 may be brass washers. Thickness of element 370 and the other in-handle portions is shown exaggerated, for exposition, the spacing at 377 being less in proportion than shown.

Figure 4:
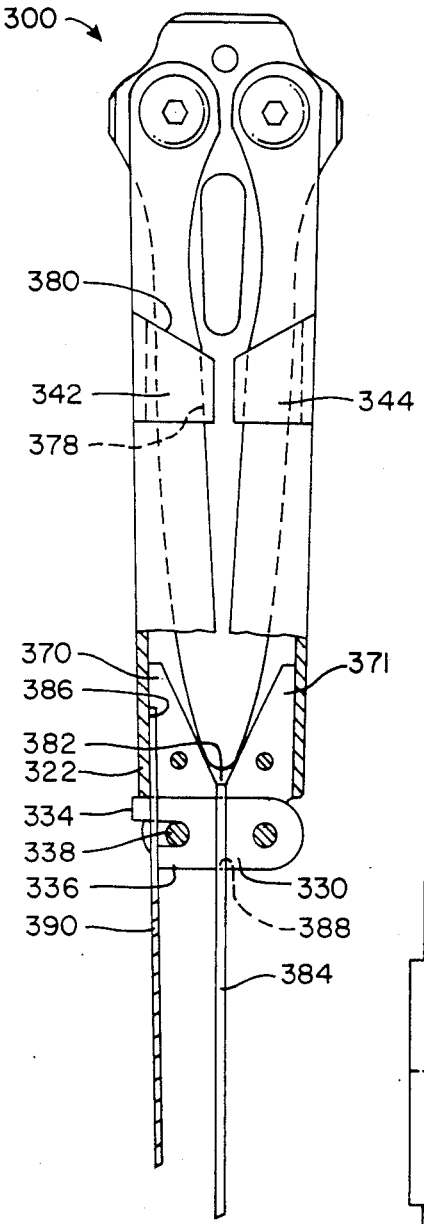
FIG. 4 is a face view partially broken away for exposition of the FIG. 3 embodiment in folded position for use with removable accessories.

FIG. 4 shows a folded position of the embodiment 300, with additional provisions. Embodiment 300 may or may not have serrations for plier jaws as in the first embodiment, but because the aluminum of the handles may be soft, harder clipon-attachment plier jaws 342, 344 are provided, one for each handle.

Each of these is a square-"C"-section sheet metal member embracing a respective handle with the ends 378 of the square-"C"-section just covering the ends of the arms of the "U"-section jaws. Preferably, the shape of each of these attachments includes an incline 380 for clearing the wire cutter section while extending a substantial distance along a handle, for stability and strength.

Shown, also, with overlying handle structure broken away are the blade centerers 370, 371 in the handles. These, when together, have a space 382 that receives and clamps centrally between the handles, by means of the blade centerers, the upper end of an implement 384 such as a saw blade. A slot 388 in the implement receives the tool block 330. Hand-pressure alone is needed to hold the saw blade secure with the tool block passing through it and the blade centerers clamping it.

To hold in an optional manner a saw blade or other implement (for purposes of this application "saw blade" is used to include chisels, augers and other such hand tool implements) slot 386 is provided along the handle 322 as a longitudinal recess in blade centerer 370. Through this, the relatively thin tool block 330 protrudes at lug portion 334 and with the bifurcate portion of the tool block engaging fastener 338, secures the implement 390 with the lug or jaw-portion 334 through the slot and shorter jaw-portion 336 bracing the side of the implement. The two implements would not normally be used together but both are shown, for exposition.

Figure 5:
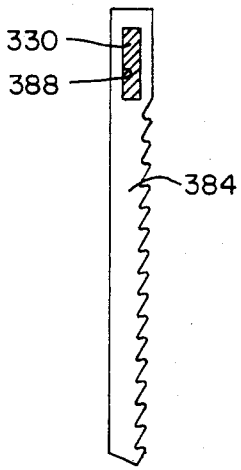
FIG. 5 is a fragmentary view of a portion of the FIG. 3 embodiment, with a portion of an accessory selection.

FIG. 5 shows the relation of a centrally-held implement 384 with slot 388, and tool block 330.

Figure 6:
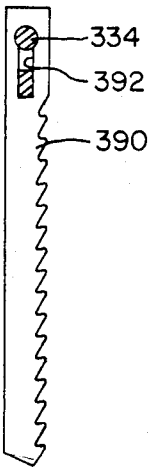
FIG. 6 is a fragmentary view of a portion of the FIG. 3 embodiment,with a portion of an accessory selection.

FIG. 6 similarly shows the relation of an implement 390 with the tool block portion 334 in the slot 392, as in FIG. 4.

Figure 7:
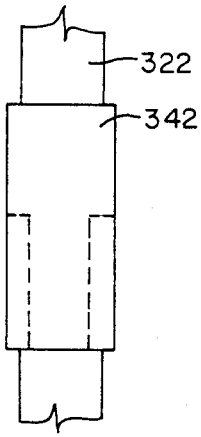
FIG. 7 is a fragmentary view of a portion of the FIG. 3 embodiment with a portion of an accessory.

FIG. 7 shows a clip-on attachment jaw 342 attached to a handle 322.

Figure 8:
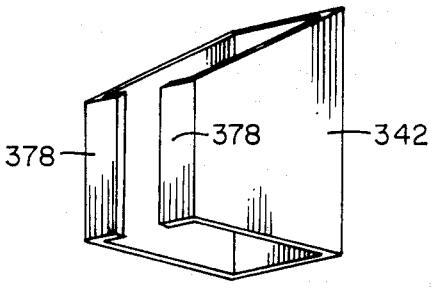
FIG. 8 is a perspective view of an accessory shown in FIGS. 4 and 7.

FIG. 8 shows a clip-on attachment jaw 342 in perspective view, 378 being the ends for engaging the ends of the ends of the arms. These members may be made of case hardened steel, preferably plated. They can be bent for installation, after heat treatment.

Figure 9:
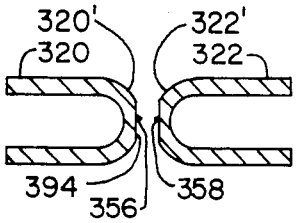
FIG. 9 is a cross-sectional diagram of an embodiment showing handle adaptation for setting exposure of a wirecutting portion.

FIG. 9 shows a provision for setting the amount of protrusion of the wire cutter opposed edges 356, 358, and for forming a plier-section at 394 more stable than the rounded convex edges 320', 322' of the handles 320, 322 would alone.

A portion reduced during manufacture, by grinding or other conventional means, forming flat 394 along the convex edge of one or both "U"-section handles 320, 322 provides both advantages. Reduction in other words, flattens the gripping surfaces and establishes amount of protrusion of the cutting edges above the reduced portion.

Figure 10:
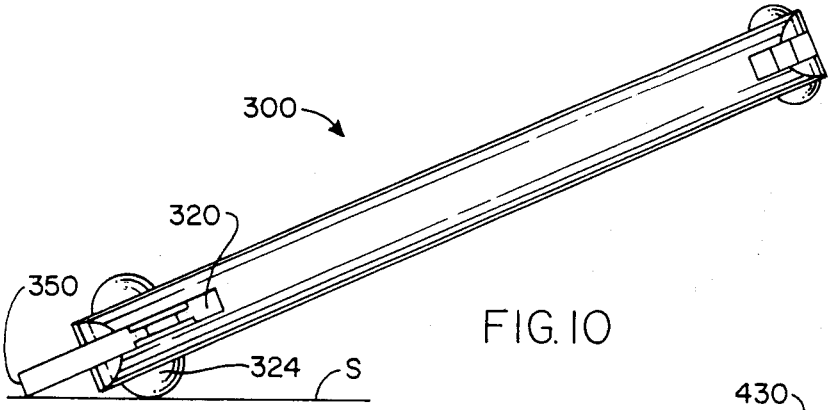
FIG. 10 is an elevational view of an embodiment of the invention in folded position being used as a scraper.

FIG. 10 shows the embodiment 300 being used as a precision surface-scraper. In scraping a surface S, the substantially square-section butt end 350 of the knife blade 320 is inclined preferably at about a 30° angle to the surface to be scraped by contact of the knife blade butt end and the protrusive heads 324 shown, on the two pivot pin fasteners, which may be press-rivets or may have small wrenching sockets permitting easy blade replacement. Each face of the scraper may be so-equipped, providing a double scraper. The protrusive heads also serve as anti-slip members improving hand grip whether the device is being used as scraper, screwdriver, or knife, or when sharpening the scraper.

Figure 11:
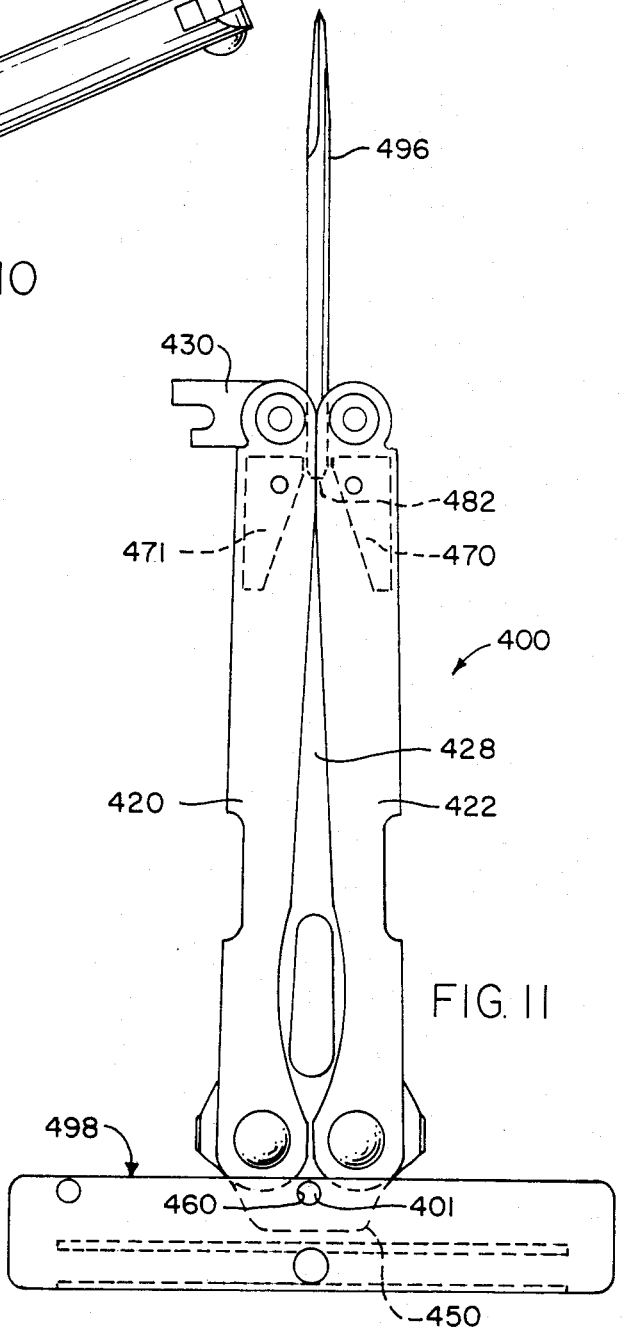
FIG. 11 is an elevational view of an embodiment of the invention including a multipurpose case/handle attached to a knife blade of the system.

FIG. 11 shows the invention in embodiment 400 in use with an auger implement 496 held centrally on the axis in a socket 482 between blade centerers 470, 471, and ends of the handles 420, 422 with pivotal block 430 swung out of the way.

For better purchase in rotating or turning the implement as in boring a hole, a container 498 is affixed transversely or in "T"-configuration to the butt of the knife blade 428 at hole 460 by a pin 401, that can be a punch, usable in the same manner as the other implements also. A slot receives the butt end 450 of the blade securely, providing for substantial torque to be easily exerted and also for substantial force to be exerted axially.

Figure 12:
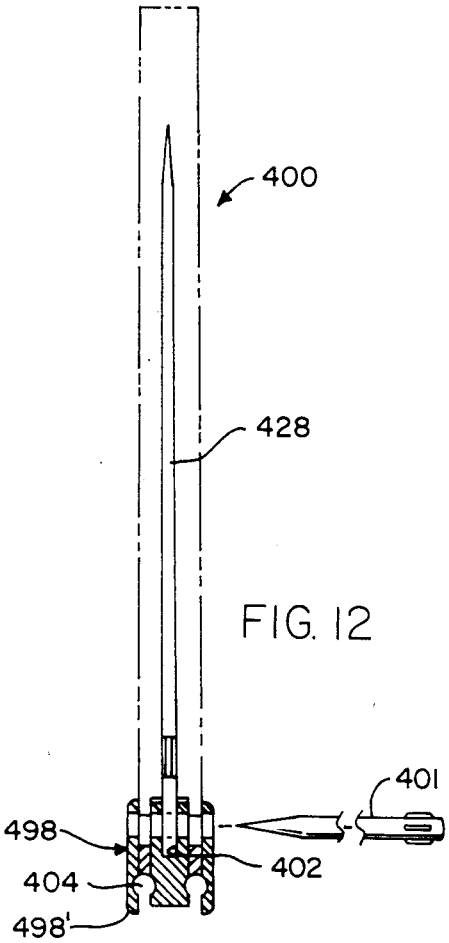
FIG. 12 is an end elevational view in partial section of the multipurpose case/handle attached to the knife blade; the remainder of the system being indicated in broken lines for exposition.

FIG. 12 shows embodiment 400 without the augur and with portions indicated in broken lines to show relation and attachment of the blade 428 better. It is evident that the bare knife blade could be held by the pin 401 in the socket 402 of the container 498, which would become the knife handle.

Augur blades and punches can be stored in longitudinal holes 404 in the container, and saw blades and similar implements can be stored in the longitudinal slots. Protruding bottom edges 498' of the container sides 498 provide for the container to be closed conveniently and economically by a spring clip.

Figure 13:
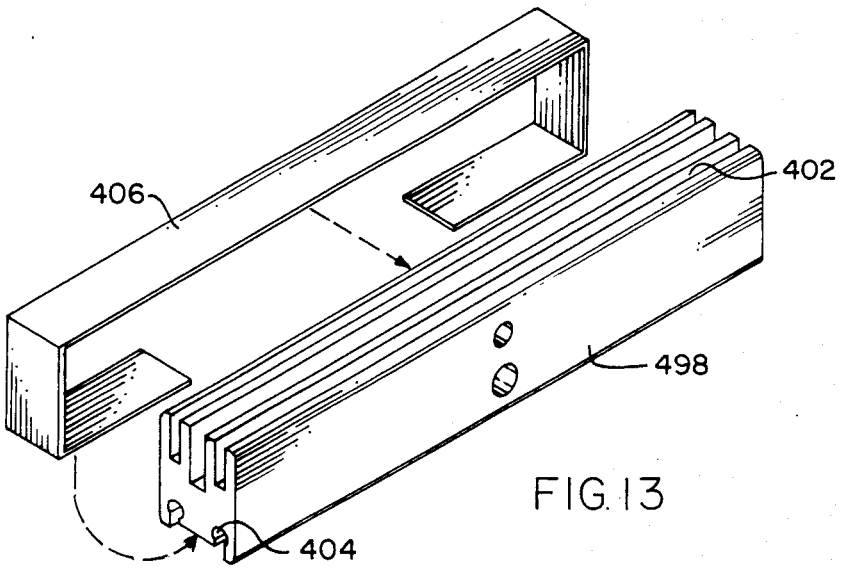
FIG. 13 is an exploded perspective view of the multipurpose case/handle with snap-on cover.

FIG. 13 shows the container 498 and the spring clip 406 that can be snapped over it, closing the slots 402 along the top and ends and the holes 404 in the ends.

FIG. 14 diagrams a further storage and carrying provision. A case 508 in the form of a storage box can carry a knife in a recessed pocket or drawer 510 in the base.

On the base are recesses for spare parts and associated items such as spare pivot pins at 524, fish line at 514 and hooks at 516, honing stone at 518, Allen wrenches at 520, capsules at 522 and the like. Finally, a water tight cover 526 with gasket 528 that seals against surface 512 carries recessed in each of the two faces a spare knife blade 28 secured by a spare pivot pin 24 passing through the top. Spring clips 530 hold the cover closed.

Figure 15:
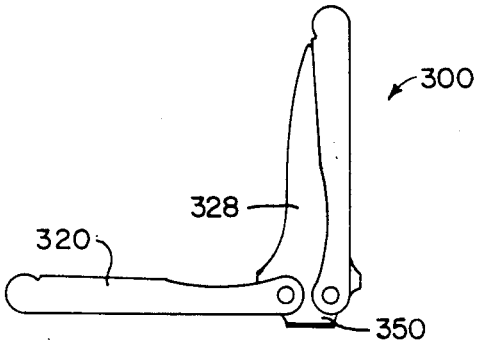
FIG. 15 is an elevational view showing a mode of use of the system as an offset screwdriver.

FIG. 15 shows a mode of use of the embodiment 300 as an offset screwdriver with one of the handles 320 providing torque to drive the screwdriver blade 350; both handles can be used simultaneously for this. The reinforcing members described in reference to FIG. 2 would add useful strength to the blade 328 and protect the parts in such heavy duty use as this.

FIG. 16 shows a further mode of use, the blade 328 being used for heavy dicing, with one handle 320 over it permitting direct pressing down (arrow) and the other handle 322 extended to the rear.

FIG. 17 shows a folding knife in embodiment 600 that is similar to other embodiments described except that it is smaller in scale; the blade 628 has a bottle cap remover 630 at the base of the sharp edge; there is no provision for holding tools and the blade pivot fasteners 624, 626 may be countersunk flush with the surface of the handles.

FIG. 18 shows in section the flush relation of the fasteners, 624 shown, to the structure of the handles, 620 shown, and knife blade 628. Folded length is compact; about 9 cm.

This invention is not to be construed as limited to the particular forms disclosed herein, since these are to be regarded as illustrative rather than restrictive. It is, therefore, to be understood that the invention may be practiced within the scope of the claims otherwise than as specifically described. For example, the integral teeth in the handles of embodiment 600 may be used in the other embodiments.

What is claimed and desired to be protected by United States Letters Patent is:

1. In a system of folding pocket tool of the type having: a knife blade, first and second substantially "U"-section paired handles pivotally attached to the knife blade and positionable for selectively enclosing therebetween and for exposing said knife blade, means for centering the knife blade relative to said first and second handles, means for securing detachably as part of said system any of a plurality of material working implements such as a saw blade, and the knife blade having a substantially square-section portion at an end thereof, the improvement comprising: said means for securing including a pivotal block with a bifurcated end on said first handle for passing through an aperture in a material working implement and a pin attached to said second handle in position for passing into said bifurcate end and holding said material working implement between said first and second handles, and means for centering said material working implement between said handles.

2. In a system as recited in claim 1, said means for centering the knife blade comprising first and second blade centerers spaced for receiving therebetween a portion of a material-working implement held by said pivotal block.

3. In a system as recited in claim 2, said blade centerers being in the handles and each blade centerer fitting a respective "U"-section of a handle.

4. In a system as recited in claim 3, said handles being of relatively soft metal such as aluminum, said pivotal block being held by a pivot to the first said handle within the "U"-section thereof, and means for protecting said first handle from scarring on assembly of the pivotal block comprising said pivot being of two parts proportioned for pressfitting together through a hole in said first handle.

5. In a system as recited in claim 3, said handles being of soft metal such as aluminum and means for permitting each said handle to be used as an off-set screwdriver handle at right angles to said substantially square section blade portion of the knife blade while protecting each said handle from scarring, comprising: for said pivotal attachment each handle having a pivot pin connecting it to a respective part of said knife blade, and a pair of reinforcing members on each pivot pin isolating each handle from the knife blade.

6. In a system as recited in claim 2, the folding pocket tool being of the type having a plier section, said plier section comprising a respective clip-on attachment jaw on each handle in position opposing the clip-on attachment jaws.

7. In a system as recited in claim 6, the knife blade being of the type having a slot therein at a location intermediate first and second ends of the knife blade, in said paired handle pivotal position for enclosing the handles, said slot being exposed, and said clip-on attachment jaws having a shape avoiding covering said exposed slot.

8. In a system of folding pocket tool of the type having a knife blade, substantially "U"-section paired handles pivotally attached to the knife blade and positionable for selectively enclosing therebetween and for exposing said knife blade, means for centering the knife blade relative to said handles, means for securing as part of said system any of a plurality of material-working implements such as a saw blade, and the knife blade having a substantially square-section portion at an end thereof, the improvement comprising said means for securing including a pivotal block on a said handle and having means for detachably holding a saw balde by an aperture in the saw blade, means for centering said saw blade between said handles, said means for centering said saw blade comprising first and second blade centerers, each fixed to one of said handles and spaced for receiving therebetween a portion of a material-working implement held by said pivotal block, the folding pocket tool having a wire cutter protrusion extending from an outer curved portion of at least one of said "U"-section paired handles, and means for forming a plier section, comprising a reduced portion forming a flat along at least one of said handles at said outer curved portion of the "U"-section from which said protrusion extends.

9. In a system of folding pocket tool of the type having a knife blade, substantially "U"-section paired handles pivotally attached to the knife blade and positionable for selectively enclosing therebetween and for exposing said knife blade, means for centering the knife blade relative to said handles, means for securing as part of said system any of a plurality of material-working implements such as a saw blade, and the knife blade having a substantially square-section portion at an end thereof, the improvement comprising: said means for securing including a pivotal block on a said handle and having means for detachably holding a saw blade by an aperture in the saw blade, means for centering said saw blade between said handles, said means for centering said saw blade comprising first and second blade centerers, each fixed to one of said handles and spaced for receiving therebetween a portion of a material-working implement held by said pivotal block, and means for turning said system as in boring, including a container having means for attachment transverse to the knife blade at a hole adjacent to said square-section potion in the knife blade.

10. In a system as recited in claim 9, said means for attachment including a punch detachably affixable through an opening in said container and through said hole in the knife blade.

11. In a system as recited in claim 10, said means for attachment further including a slot in said container receiving therein said substantially square section portion of the knife blade.

12. In a system as recited in claim 11, said slot proportioned for storage of a saw said blade therein.

13. In a system as recited in claim 12, and at least one hole in said container for storage of a said punch therein.

14. In a system as recited in claim 13, said container being elongate, and a plurality of said slots and holes along said elongate container.

15. In a system as recited in claim 14, a spring clip cover for stubstantially surrounding said elongate container endwise and covering said slots and holes.

16. In a system as recited in claim 2, said substantially square section portion of the knife blade providing on each side a scraper-edge, the pivotal attachment of said "U"-section handles to the knife blade being by means of a respective protrusive-head fastener attaching each handle to the knife blade, and protrusion of the protrusive-head fastener proportioned for guiding the scraper-edge at a correct angle for scraping with the scraper-edge.

17. In a system as recited in claim 2, the knife blade having a bottle cap opener therein, and a plurality of plier teeth integrally formed in each handle.

18. In a system as recited in claim 17, said system having a compact folded length of about 9 cm.

* * * * *